US005474868A

United States Patent [19]

Adachi et al.

[11] Patent Number: 5,474,868

[45] Date of Patent: Dec. 12, 1995

[54] ELECTROPHOTOGRAPHIC PHOTOCONDUCTOR WITH LIGNIN

[75] Inventors: Hiroshi Adachi, Numazu; Masaomi Sasaki, Susono; Tamotsu Aruga, Mishima, all of Japan

[73] Assignee: Ricoh Company, Ltd., Tokyo, Japan

[21] Appl. No.: 361,580

[22] Filed: Dec. 22, 1994

[30] Foreign Application Priority Data

Dec. 22, 1993 [JP] Japan ..... 5-346508
Feb. 21, 1994 [JP] Japan ..... 6-046442

[51] Int. Cl.[6] ..... G03G 5/04

[52] U.S. Cl. ..... 430/58; 430/56; 430/59; 430/83

[58] Field of Search ..... 430/56, 58, 59, 430/83

[56] References Cited

U.S. PATENT DOCUMENTS

| | | | |
|---|---|---|---|
| 4,218,528 | 8/1980 | Shimada et al. | 430/76 |
| 5,053,301 | 10/1991 | Kato et al. | 430/49 |
| 5,077,165 | 12/1991 | Kato et al. | 430/49 X |
| 5,158,850 | 10/1992 | Sasaki et al. | 430/71 |
| 5,248,826 | 9/1993 | Sasaki et al. | 564/307 |
| 5,319,069 | 6/1994 | Sasaki et al. | 528/425 |

*Primary Examiner*—Roland Martin
*Attorney, Agent, or Firm*—Oblon, Spivak, McClelland, Maier, & Neustadt

[57] ABSTRACT

An electrophotographic photoconductor having an electroconductive support and a photoconductive layer formed thereon containing a charge generating material, a charge transporting material and lignin.

21 Claims, No Drawings

ELECTROPHOTOGRAPHIC PHOTOCONDUCTOR WITH LIGNIN

BACKGROUND OF THE INVENTION

1. Field of the Invention

The present invention relates to an electrophotographic photoconductor comprising an electroconductive support and a photoconductive layer formed thereon, containing lignin.

2. Discussion of Background

Conventionally, inorganic materials such as selenium, cadmium sulfide and zinc oxide are used as photoconductive materials for electrophotographic photoconductors for use in electrophotography. Electrophotography is one of the image formation processes, through which the surface of a photoconductor is charged uniformly in the dark to a predetermined polarity, for instance, by corona charge. The uniformly charged photoconductor is exposed to a light image to selectively dissipate the electric charges of the exposed areas, so that a latent electrostatic image is formed on the photoconductor. The thus formed latent electrostatic image is developed into a visible image with a developer comprising a coloring agent such as a dye or a pigment, and a binder agent such as a polymeric material.

Fundamental characteristics required for the photoconductor for use in such electrophotography are: (1) chargeability to an appropriate potential in the dark, (2) minimum dissipation of electric charges in the dark, and (3) rapid dissipation of electric charges when exposed to light.

However, while the above-mentioned inorganic materials have many advantages over other materials, they have several shortcomings from the viewpoint of practical use.

For instance, a selenium photoconductor, which is widely used at present, satisfies the above-mentioned requirements (1) to (3) completely, but it has the shortcomings that its manufacturing conditions are difficult and, accordingly, its production cost is high. In addition, it is difficult to work it into the form of a belt due to its poor flexibility. Furthermore, the selenium photoconductor is so vulnerable to heat and mechanical shocks that it must be handled with the utmost care.

A cadmium sulfide photoconductor and a zinc oxide photoconductor can be respectively produced by dispersing cadmium sulfide particles and zinc oxide particles in a binder resin. However, they are poor in mechanical properties such as surface smoothness, hardness, tensile strength and wear resistance. Therefore, they cannot be used repeatedly, as they are.

To solve the problems of such inorganic materials, various electrophotographic photoconductors employing organic materials are recently proposed. For example, there are known a photoconductor comprising poly-N-vinylcarbazole and 2,4,7-trinitrofluorenone-9-on as described in U.S. Pat. No. 3,484,237; a photoconductor prepared by sensitizing poly-N-vinylcarbazole with a pyrylium-salt-based pigment as described in Japanese Patent Publication 48-25658; a photoconductor comprising as a main component an organic pigment as described in Japanese Laid-Open Patent Application 47- 37543; a photoconductor comprising as a main component a eutectic crystal complex composed of a dye and a resin as described in Japanese Laid-Open Patent Application 47- 10735; a photoconductor prepared by sensitizing a triphenylamine compound with a sensitizer pigment as described in U.S. Pat. No. 3,180,730; a photoconductor comprising an amine derivative as a charge transporting material as described in Japanese Laid-Open Patent Application 57-195254; a photoconductor comprising poly-N-vinylcarbazole and an amine derivative as charge transporting materials as described in Japanese Laid-Open Patent Application 58-1155; and a photoconductor comprising as a photoconductive material a polyfunctional tertiary amine compound, in particular, a benzidine compound, as described in U.S. Pat. No. 3,265,496, Japanese Patent Publication 39-11546 and Japanese Laid-Open Patent Application 53-27033.

These organic electrophotographic photoconductors are still unsatisfactory for use in practice, especially with respect to the durability thereof. As the demand for a photoconductor with higher durability is increasing year by year, ensuring the charging stability in the photoconductor has become a requirement that cannot be ignored. When a photoconductor with a decreased charging stability is employed, in the case of an electrophotographic copying machine, the lowering of image density is caused; and in the case of a laser printer employing the reversal development method, image quality is lowered, for instance, with the occurrence of toner deposition on the background of printed images. In order to solve these problems, it is proposed to provide an intermediate layer between an electroconductive support and a photoconductive layer. However, in the case where a material with high resistivity, having high barrier properties, is employed for the intermediate layer, the photosensitivity of the photoconductor decreases and the residual potential thereof increases although the charging characteristics are improved. When a material with relatively low resistivity is employed for the intermediate layer to prevent the increase of the residual potential, the charging stability of the photoconductor is still insufficient.

When a photoconductor is incorporated into a copying machine in practice, the photoconductor is exposed to ozone generated from a corona charger. By the ozone thus generated, organic materials such as a charge transporting material contained in a photoconductive layer of the photoconductor are oxidized, so that there are caused the problems that the photosensitivity is decreased, the residual potential is increased, and the charging potential is decreased.

To solve such problems, the addition of an antioxidant to the photoconductive layer is proposed as in Japanese Laid-Open Patent Applications 57-122444, 50- 33857, 63-18355, 63-18356 and 3-172852; and the provision of a gas-barrier resin layer on the charge transport layer is also proposed as in Japanese Laid-Open Patent Application 63-135955.

The above-mentioned countermeasures, however, have not yet solved the problems of the conventional photoconductors, such as the increase of the residual potential, the lowering of the photosensitivity, and the insufficient improvement of the durability thereof.

SUMMARY OF THE INVENTION

It is therefore an object of the present invention to provide an electrophotographic photoconductor free from the conventional shortcomings, which is capable of producing high quality images and has excellent resistance to ozone, with a minimum increase of the residual potential and excellent charging characteristics, and without toner deposition on the background of images even when used repeatedly over a long period of time.

The object of the present invention can be achieved by an electrophotographic photoconductor comprising an electroconductive support and a photoconductive layer formed thereon, which photoconductive layer comprises a charge generating material, a charge transporting material and lignin.

In the above-mentioned electrophotographic photoconductor, the photoconductive layer may further comprise an antioxidant in combination with lignin for further improvement of the ozone resistance of the photoconductive layer. Furthermore, the photoconductive layer may further comprise alumina for the improvement of the charging characteristics, such as charging stability, of the photoconductive layer.

The above electrophotographic photoconductor may be of a function-separated type, in which the photoconductive layer comprises a charge generation layer and a charge transport layer, one of which is overlaid on the other. In this case, at least one of the charge generation layer or the charge transport layer comprises lignin. In addition to the lignin, the above-mentioned antioxidant and/or alumina may be contained in at least one of the charge generation layer or the charge transport layer. For efficient improvement of the charging stability of the photoconductor, it is preferable to contain alumina in the charge generation layer.

DESCRIPTION OF THE PREFERRED EMBODIMENTS

In an electrophotographic photoconductor according to the present invention, a photoconductive layer is provided on an electroconductive support, which photoconductive layer comprises a charge generating material, a charge transport material, and lignin.

The lignin for use in the photoconductive layer is an amorphous polymeric material which is present as the cell wall component of vascular bundle in plants. The chemical structure of lignin has not been clarified, but the following variations of an aromatic nucleus are conventionally known as a constitutive unit of the lignin:

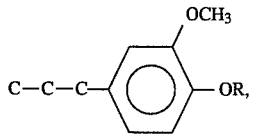

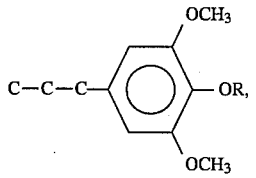

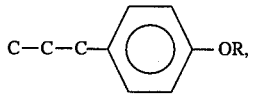

and

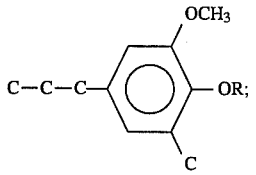

wherein R is hydrogen, an aliphatic hydrocarbon group, or an aromatic hydrocarbon group. To isolate lignin from the plant body, other components than lignin in the plant body may be dissolved to obtain lignin as an insoluble residue, or lignin may be dissolved to separate from other components. The isolated lignin is named after the isolating method. The lignin isolated by the former method is called an insoluble lignin, which includes an acid lignin such as sulfuric acid lignin and hydrochloric acid lignin, cuproxam lignin, and periodate lignin. The lignin isolated by the latter method is called a soluble lignin, which is classified into two groups. One includes the lignin and lignin derivatives obtained by use of an inorganic reagent, such as alkali lignin, lignosulfonic acid, thiolignin, and chlorolignin; and the other includes the lignin and lignin derivatives by use of an organic reagent, such as Brauns native lignin, Björkman lignin, dioxane lignin, hydrotropic lignin, alcohol lignin, phenol lignin, acetic acid lignin, "Lignin, hydrolytic" (Trademark), made by Aldrich Chemical Company, Inc., 2-acetoxyethyl ether lignin, 2-hydroxyethyl ether lignin, propionate lignin, carboxymethyl ether alkali lignin, 2-hydroxypropyl ether alkali lignin, and "Lignin, organosolv" (Trademark), made by Aldrich Chemical Company, Inc.

Although any of the above-mentioned lignin and lignin derivatives can be used in the present invention, the lignin with little chemical change is further preferable.

In the present invention, the photoconductive layer may comprise an antioxidant together with the lignin.

The antioxidant which is used in combination with the lignin serves to prevent the oxidation of organic materials for use in the photoconductor. In the present invention, any antioxidants which are generally contained in the materials subject to oxidation, such as foods, oils and fats, plastics and rubbers, are used to prevent the deterioration of the functions of the organic materials employed in the photoconductive layer.

The oxidation reaction is caused through the steps of the generation of a radical, the chain propagation, and the decomposition of a peroxide. The antioxidant for use in the present invention can be classified into the following three groups in accordance with the above-mentioned steps:

(1) An ultraviolet absorber capable of absorbing the ultraviolet light to prevent the generation of a radical.

(2) A chain inhibitor to stop the chain propagation of the radical.

(3) A peroxide decomposer capable of being allowed to react with a peroxide to turn the peroxide into an inert compound before the peroxide is decomposed into radicals.

Salicylic acid compounds, benzophenone compounds and benzotriazole compounds are employed as the ultraviolet absorber (1); phenolic compounds and amine compounds, as the chain inhibitor (2); and sulfur-containing compounds and phosphorus-containing compounds, as the peroxide decomposer (3). A plurality of antioxidants can be employed in the photoconductive layer in the present invention. For instance, the combination of a phenolic compound and a phosphorus-containing compound, or an amine compound and a sulfur-containing compound may be employed to obtain the synergistic effect.

Specific examples of the antioxidant for use in the photoconductive layer are shown in the following Tables 1 through 10:

TABLE 1

(1) Alkylated monophenol

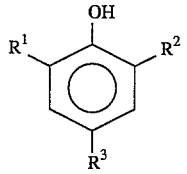

| Compound No. | $R^1$ | $R^2$ | $R^3$ |
|---|---|---|---|
| 1 | t-$C_4H_9$ | t-$C_4H_9$ | $CH_3$ |
| 2 | t-$C_4H_9$ | t-$C_4H_9$ | $C_2H_5$ |
| 3 | t-$C_4H_9$ | t-$C_4H_9$ | $C_3H_7$ |

TABLE 1-continued (1) Alkylated monophenol

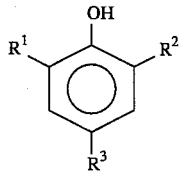

| Compound No. | $R^1$ | $R^2$ | $R^3$ |
|---|---|---|---|
| 4 | t-$C_4H_9$ | t-$C_4H_9$ | n-$C_4H_9$ |
| 5 | t-$C_4H_9$ | t-$C_4H_9$ | t-$C_4H_9$ |
| 6 | t-$C_4H_9$ | t-$C_4H_9$ | sec-$C_4H_9$ |
| 7 | t-$C_4H_9$ | t-$C_4H_9$ | i-$C_4H_9$ |
| 8 | t-$C_4H_9$ | t-$C_4H_9$ | $OCH_3$ |
| 9 | t-$C_4H_9$ | t-$C_4H_9$ | $OC_2H_5$ |
| 10 | t-$C_4H_9$ | t-$C_4H_9$ | H |
| 11 | t-$C_4H_9$ | H | $CH_3$ |
| 12 | t-$C_4H_9$ | H | $C_2H_5$ |
| 13 | t-$C_4H_9$ | H | n-$C_4H_9$ |
| 14 | t-$C_4H_9$ | H | t-$C_4H_9$ |
| 15 | t-$C_4H_9$ | H | $OCH_3$ |
| 16 | t-$C_4H_9$ | H | H |
| 17 | t-$C_4H_9$ | $CH_3$ | $CH_3$ |
| 18 | t-$C_4H_9$ | $CH_3$ | $C_2H_5$ |
| 19 | t-$C_4H_9$ | $CH_3$ | n-$C_4H_9$ |
| 20 | t-$C_4H_9$ | $CH_3$ | t-$C_4H_9$ |
| 21 | t-$C_4H_9$ | $CH_3$ | $OCH_3$ |
| 22 | t-$C_4H_9$ | $CH_3$ | H |
| 23 | 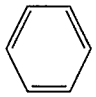 | 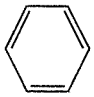 | 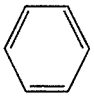 |

TABLE 2

(2) Alkylated hydroquinone

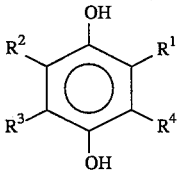

| Compound No. | $R^1$ | $R^2$ | $R^3$ | $R^4$ |
|---|---|---|---|---|
| 24 | t-$C_4H_9$ | H | t-$C_4H_9$ | H |
| 25 | t-$C_5H_{11}$ | H | t-$C_5H_{11}$ | H |
| 26 | t-$C_4H_9$ | H | H | H |

TABLE 3

(3) Hydroxylated thiodiphenyl ether

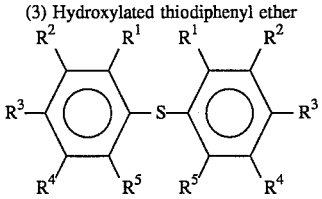

| Compound No. | $R^1$ | $R^2$ | $R^3$ | $R^4$ | $R^5$ |
|---|---|---|---|---|---|
| 27 | OH | t-$C_4H_9$ | H | $CH_3$ | H |
| 28 | OH | H | H | n-$C_8H_{17}$ | H |
| 29 | $CH_3$ | H | OH | t-$C_4H_9$ | H |
| 30 | H | $CH_3$ | OH | t-$C_4H_9$ | H |

TABLE 4

(4) Alkylidenebisphenol

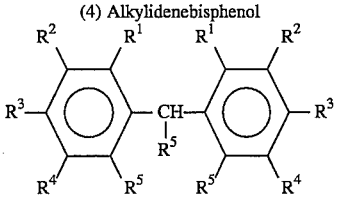

| Compound No. | $R^1$ | $R^2$ | $R^3$ | $R^4$ | $R^5$ | $R^6$ |
|---|---|---|---|---|---|---|
| 31 | OH | t-$C_4H_9$ | H | $CH_3$ | H | H |
| 32 | OH | 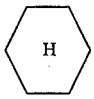 | H | $CH_3$ | H | H |
| 33 | OH | t-$C_4H_9$ | H | t-$C_4H_9$ | H | H |
| 34 | OH | t-$C_4H_9$ | H | $C_2H_5$ | H | H |
| 35 | OH | t-$C_4H_9$ | H | t-$C_4H_9$ | H | H |
| 36 | OH | n-$C_9H_{19}$ | H | $CH_3$ | H | H |
| 37 | OH | t-$C_4H_9$ | H | t-$C_4H_9$ | H | $CH_3$ |
| 38 | OH | t-$C_4H_9$ | H | i-$C_4H_9$ | H | $CH_3$ |
| 39 | H | t-$C_4H_9$ | OH | t-$C_4H_9$ | H | H |
| 40 | H | t-$C_4H_9$ | OH | $CH_3$ | H | H |
| 41 | H | t-$C_4H_9$ | OH | H | H | H |
| 42 | H | t-$C_4H_9$ | OH | H | H | $CH_3$ |
| 43 | H | $CH_3$ | OH | H | H | $CH_3$ |

TABLE 5

(5) Sesamol compounds

| Compound No. | Chemical Structure |
|---|---|
| 44 | 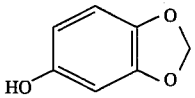 |
| 45 | 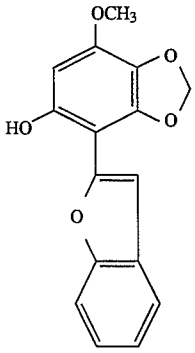 |
| 46 | 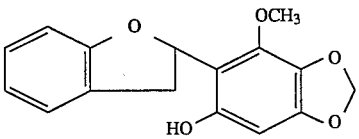 |
| 47 | 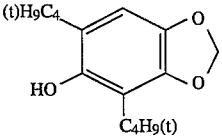 |

TABLE 5-continued
(5) Sesamol compounds
| Compound No. | Chemical Structure |
|---|---|
| 48 | 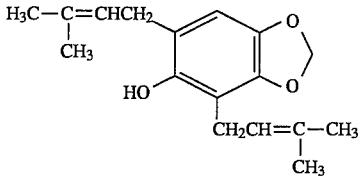 |
| 49 | 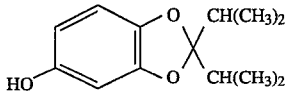 |
| 50 | 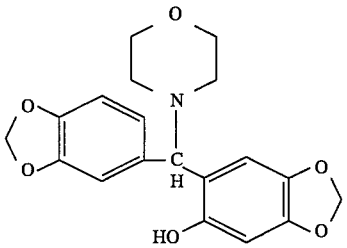 |
| 51 | 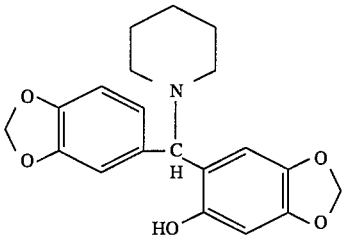 |
| 52 | 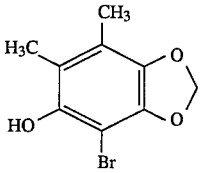 |
| 53 | 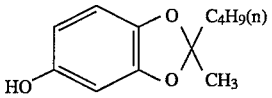 |
| 54 | 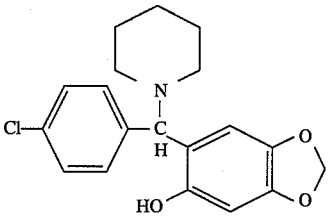 |
TABLE 5-continued
(5) Sesamol compounds
| Compound No. | Chemical Structure |
|---|---|
| 55 | 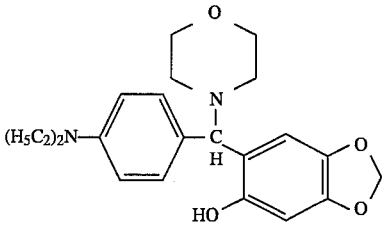 |
| 56 | 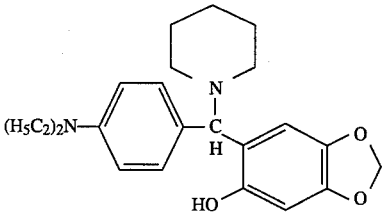 |
| 57 | 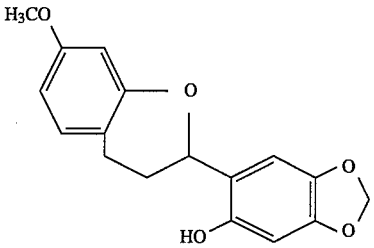 |
| 58 | 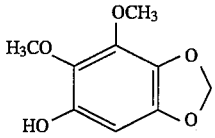 |
| 59 | 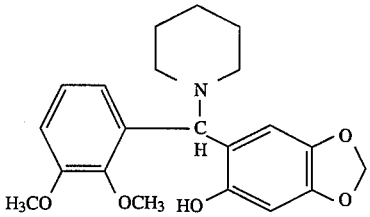 |
| 60 | 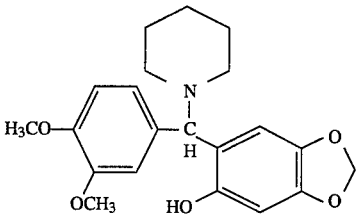 |
| 61 | 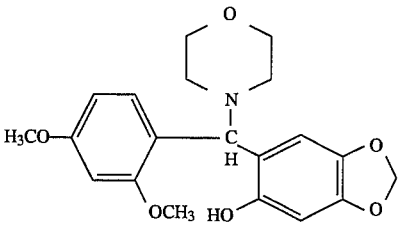 |

TABLE 5-continued
(5) Sesamol compounds
| Compound No. | Chemical Structure |
|---|---|
| 62 | 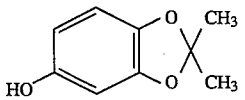 |
| 63 | 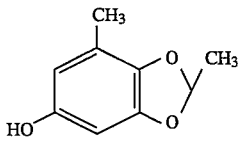 |
| 64 | 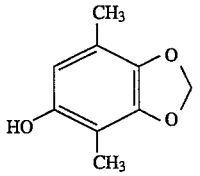 |
| 65 | 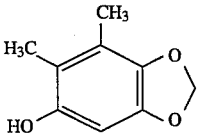 |
| 66 | 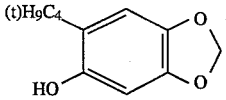 |
| 67 | 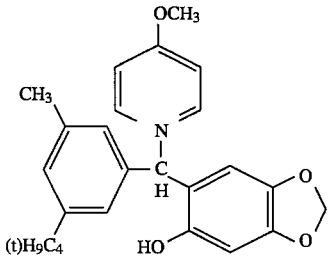 |
| 68 | 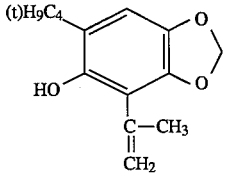 |
| 69 | 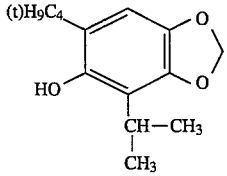 |
| 70 | 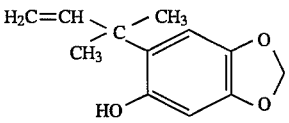 |
TABLE 5-continued
(5) Sesamol compounds
| Compound No. | Chemical Structure |
|---|---|
| 71 | 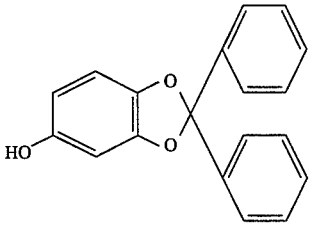 |
| 72 | 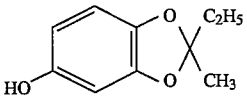 |
| 73 | 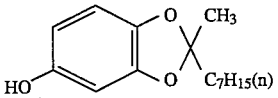 |
| 74 | 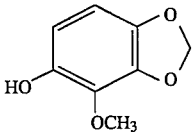 |
| 75 | 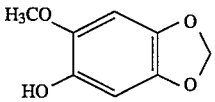 |
| 76 | 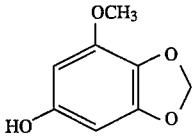 |
| 77 | 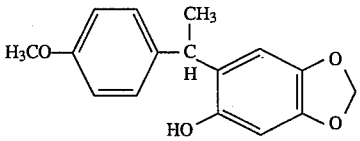 |
| 78 | 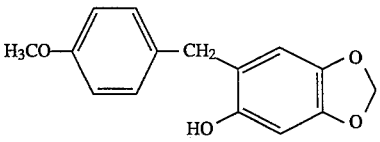 |
| 79 | 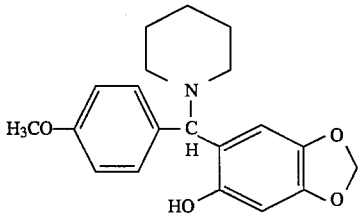 |
| 80 | 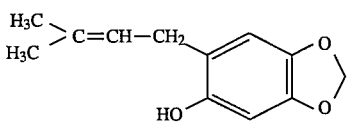 |

TABLE 5-continued
(5) Sesamol compounds
| Compound No. | Chemical Structure |
|---|---|
| 81 | 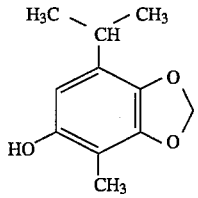 |
| 82 | 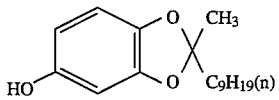 |
| 83 | 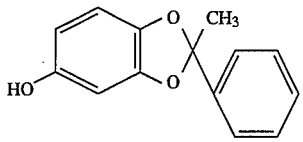 |
| 84 | 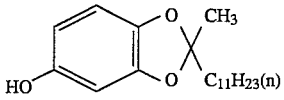 |
| 85 | 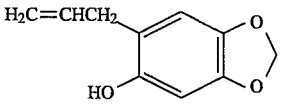 |
| 86 | 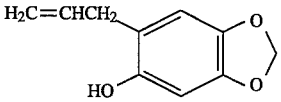 |
| 87 | 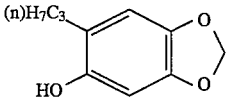 |
| 88 | 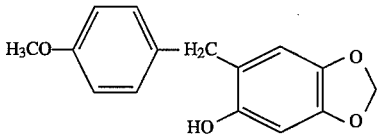 |
| 89 | 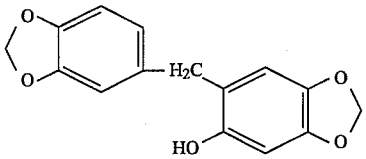 |
| 90 | 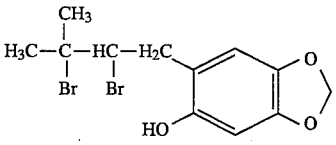 |
TABLE 5-continued
(5) Sesamol compounds
| Compound No. | Chemical Structure |
|---|---|
| 91 | 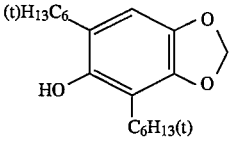 |
| 92 | 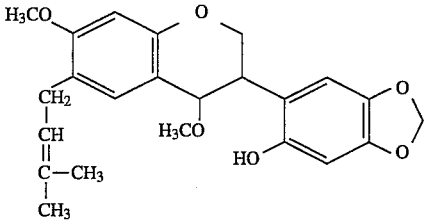 |
| 93 | 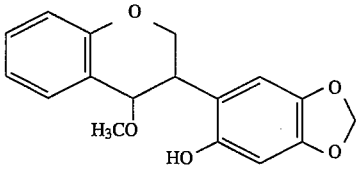 |
| 94 | 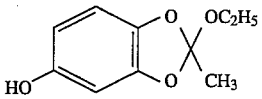 |
| 95 | 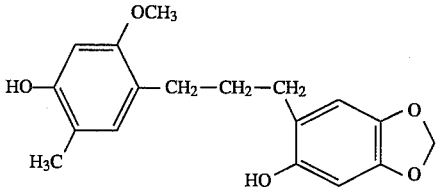 |
| 96 | 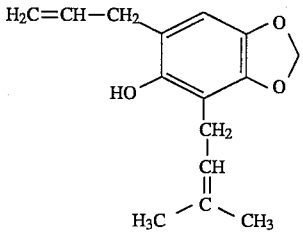 |
| 97 | 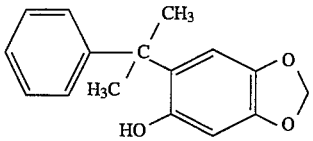 |
| 98 | 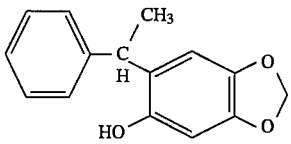 |

TABLE 5-continued
(5) Sesamol compounds
| Compound No. | Chemical Structure |
|---|---|
| 99 | 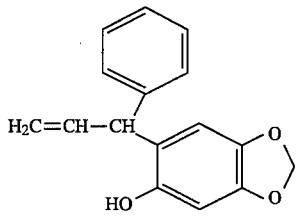 |
| 100 | 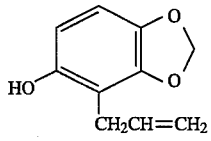 |
| 101 | 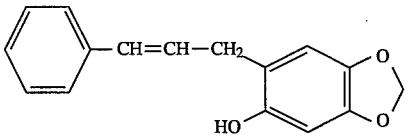 |
| 102 | 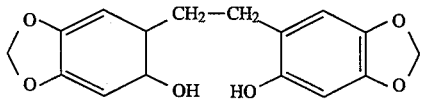 |
| 103 | 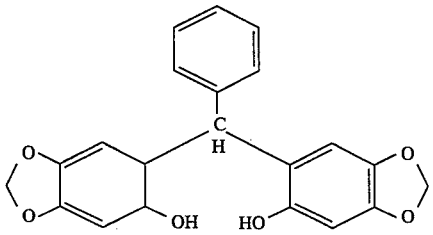 |
| 104 | 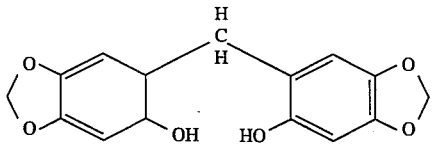 |
TABLE 6
(6) Monoamine
| Compound No. | Chemical Structure |
|---|---|
| 105 | 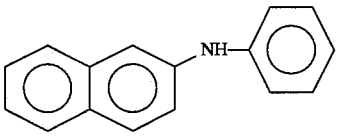 |
| 106 | 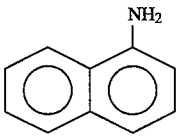 |
TABLE 7
(7) Diamine
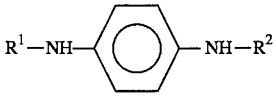
| Compound No. | $R^1$ | $R^2$ |
|---|---|---|
| 107 | 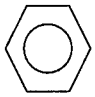 | 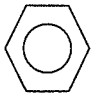 |
| 108 | t-$C_4H_9$ | t-$C_4H_9$ |
| 109 | 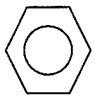 | 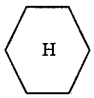 |
| 110 | 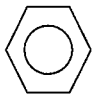 | i-$C_3H_7$ |
| 111 | 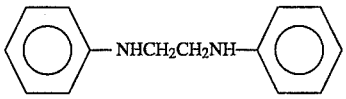 | |
| 112 | 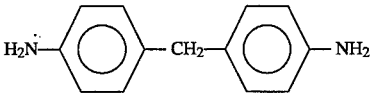 | |

TABLE 8
(8) Alicyclic amine compounds
| Compound No. | Chemical Structure |
|---|---|
| 113 | 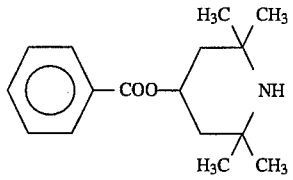 |
| 114 | 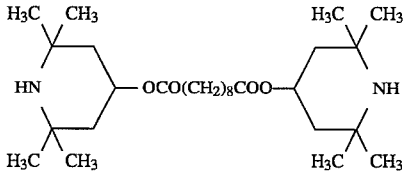 |
| 115 | 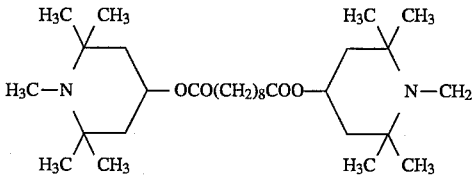 |
| 116 | 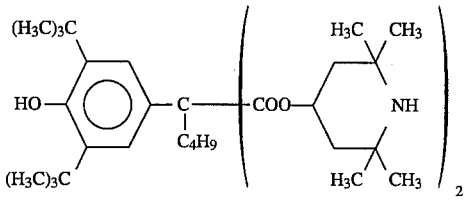 |
TABLE 9
(9) Sulfur-containing compounds
| Compound No. | Chemical Structure |
|---|---|
| 117 | $S(CH_2CH_2COOH)_2$ |
| 118 | $S(CH_2CH_2CO_2C_{12}H_{26})_2$ |
TABLE 9-continued
(9) Sulfur-containing compounds
| Compound No. | Chemical Structure |
|---|---|
| 119 | $S(CH_2CH_2CO_2C_{14}H_{29})_2$ |
| 120 | $S(CH_2CH_2CO_2C_{18}H_{37})_2$ |
TABLE 10
(10) Phosphorus-containing compounds
| Compound No. | Chemical Structure |
|---|---|
| 121 | 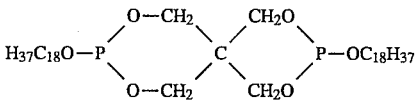 |
| 122 | $(H_{37}C_{18}O)_3P$ |

TABLE 10-continued

| (10) Phosphorus-containing compounds | |
|---|---|
| Compound No. | Chemical Structure |
| 123 | 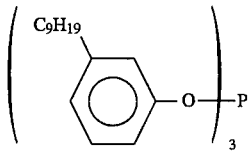 |
| 124 | 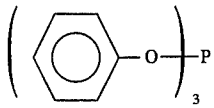 |
| 125 | 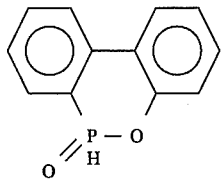 |
| 126 | 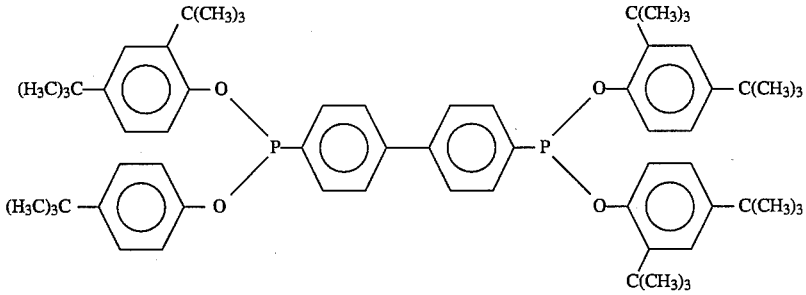 |
| 127 | 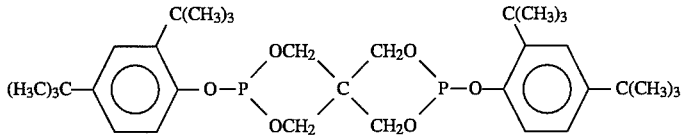 |

In the present invention, the lignin may be contained in the photoconductive layer in combination with alumina, that is, aluminum oxide, in an effective amount. Specifically, alumina in the form of powder may be contained in the formulation of a coating liquid for a photoconductive layer. Alternatively, alumina balls may be used to grind and mix the components for use in the coating liquid for the photoconductive layer in the course of milling. In such a case, the alumina balls are abraded, thereby being contained in the coating liquid in an effective amount.

According to the present invention, the photoconductive layer of the photoconductor may comprise both the above-mentioned antioxidant and alumina in the respective effective amounts thereof in combination with the lignin.

The photoconductive layer for use in the present invention comprises a charge generating material and a charge transporting material.

Specific examples of the charge generating material for use in the present invention are as follows: organic pigments, such as an azo pigment having a carbazole skeleton, an azo pigment having a styryl stilbene skeleton, an azo pigment having a triphenylamine skeleton, an azo pigment having a dibenzothiophene skeleton, an azo pigment having an oxadiazole skeleton, an azo pigment having a fluorenone skeleton, an azo pigment having a bisstilbene skeleton, an azo pigment having a distyryl oxazole skeleton, and an azo pigment having a distyryl carbazole skeleton, an azo pigment having a diphenylamine skeleton, a trisazo pigment having a carbazole skeleton, a phthalocyanine pigment such as a metal-containing phthalocyanine pigment and a metal-free phthalocyanine pigment, a quinone pigment such as anthanthrone and pyranthrone, a quinacridone pigment, a bisbenzimidazole pigment, a perylene pigment, an indigo pigment, a squarylium pigment, a quinoline pigment, a pyrylium salt pigment, and an azulenium salt pigment.

As the charge transporting material for use in the present invention, a positive-hole-transporting material and an electron-transporting material can be employed.

Examples of the positive hole transporting material include poly-N-carbazole and derivatives thereof, poly-γ-carbazolylethylglutamate and derivatives thereof, a condensation product of pyrene and formaldehyde and derivatives thereof, polyvinyl pyrene, polyvinyl phenanthrene, oxazole derivatives, imidazole derivatives, triphenylamine derivatives, and the following compounds (1) to (18):

(1) Compounds described in Japanese Laid-Open Patent Applications 55-154955 and 55-156954:

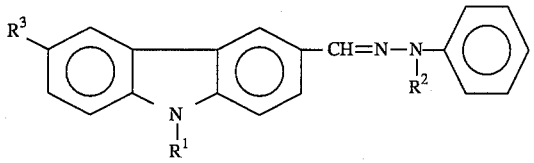

(1)

wherein $R^1$ is methyl group, ethyl group, 2-hydroxyethyl group or 2-chloroethyl group; $R^2$ is methyl group, ethyl group, benzyl group or phenyl group; and $R^3$ is hydrogen, chlorine, bromine, an alkyl group having 1 to 4 carbon atoms, an alkoxyl group having 1 to 4 carbon atoms, a dialkylamino group or nitro group.

(2) Compounds described in Japanese Laid-Open Patent Application 55-52063:

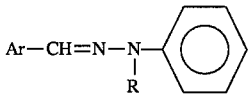

(2)

wherein Ar is naphthalene ring, anthracene ring, styryl ring, each of which may have a substituent, pyridine ring, furan ring, or thiophene ring; and R is an alkyl group or benzyl group.

(3) Compounds described in Japanese Laid-Open Patent Application 56-81850:

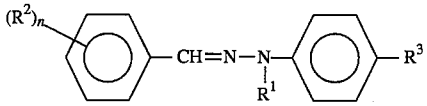

(3)

wherein $R^1$ is an alkyl group, benzyl group, phenyl group, or naphthyl group; $R^2$ is hydrogen, an alkyl group having 1 to 3 carbon atoms, an alkoxyl group having 1 to 3 carbon atoms, a dialkylamino group, a diaralkylamino group or a diarylamino group; n is an integer of 1 to 4; when n is 2 or more, $R^2$ may be the same or different; and $R^3$ is hydrogen or methoxy group.

(4) Compounds described in Japanese Patent Publication 51-10983:

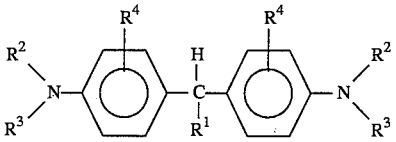

(4)

wherein $R^1$ is an alkyl group having 1 to 11 carbon atoms, a substituted or unsubstituted phenyl group, or a heterocyclic group; $R^2$ and $R^3$ which may be the same or different, each is hydrogen, an alkyl group having 1 to 4 carbon atoms, a hydroxyalkyl group, a chloroalkyl group, or a substituted or unsubstituted aralkyl group, and $R^2$ and $R^3$ in combination may form a heterocyclic ring containing nitrogen; and $R^4$, which may be the same or different, each is hydrogen, an alkyl group having 1 to 4 carbon atoms, an alkoxyl group or a halogen atom.

(5) Compounds described in Japanese Laid-Open Patent Application 51-94829:

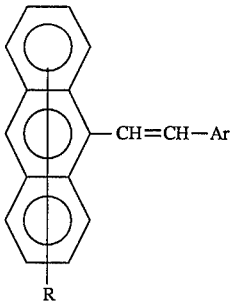

(5)

wherein R is hydrogen or a halogen atom; and Ar is a substituted or unsubstituted phenyl group, naphthyl group, anthryl group or carbazolyl group.

(6) Compounds described in Japanese Laid-Open Patent Application 52-128373:

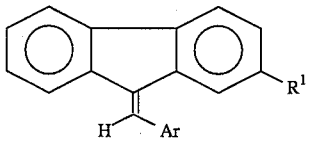

(6)

wherein $R^1$ is hydrogen, a halogen atom, cyano group, an alkoxyl group having 1 to 4 carbon atoms, or an alkyl group having 1 to 4 carbon atoms; and Ar is

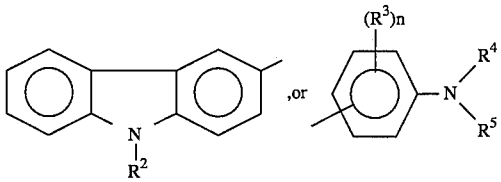

in which $R^2$ is an alkyl group having 1 to 4 carbon atoms; $R^3$ is hydrogen, a halogen atom, an alkyl group having 1 to 4 carbon atoms, an alkoxyl group having 1 to 4 carbon atoms or a dialkylamino group; n is an integer of 1 or 2; when n is 2, $R^3$ may be the same or different; and $R^4$ and $R^5$ each is hydrogen, a substituted or unsubstituted alkyl group having 1 to 4 carbon atoms or a substituted or unsubstituted benzyl group.

(7) Compounds described in Japanese Laid-Open Patent Application 56-29245:

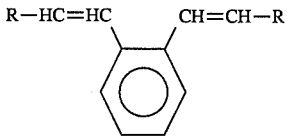

(7)

wherein R is carbazolyl group, pyridyl group, thienyl group, indolyl group, furyl group, a substituted or unsubstituted phenyl group, a substituted or unsubstituted styryl group, a substituted or unsubstituted naphthyl group, or a substituted or unsubstituted anthryl group, each of which may have a substituent selected from the group consisting of a dialkylamino group, an alkyl group, an alkoxyl group, carboxyl group or an ester group thereof, a halogen atom, cyano group, an aralkylamino group, an N-alkyl-N-aralkylamino group, amino group, nitro group and acetylamino group.

(8) Compounds described in Japanese Laid-Open Patent Application 58-58552:

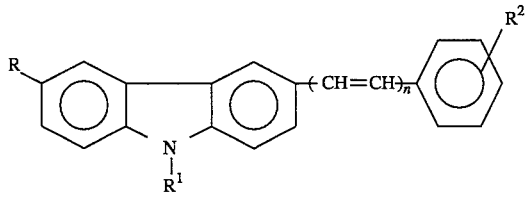

(8)

wherein $R^1$ is a lower alkyl group, substituted or unsubstituted phenyl group, or benzyl group; $R^2$ is hydrogen, a lower alkyl group, a lower alkoxyl group, a halogen atom, nitro group, an amino group which may have as a substituent a lower alkyl group or benzyl group; and n is an integer of 1 or 2.

(9) Compounds described in Japanese Laid-Open Patent Application 57-73075:

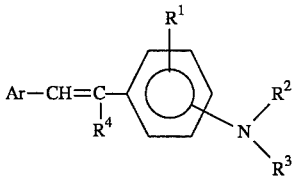

(9)

wherein $R^1$ is hydrogen, an alkyl group, an alkoxyl group or a halogen atom; $R^2$ and $R^3$ each is an alkyl group, a substituted or unsubstituted aralkyl group or a substituted or unsubstituted aryl group; $R^4$ is hydrogen, a lower alkyl group or a substituted or unsubstituted phenyl group; and Ar is a substituted or unsubstituted phenyl group or naphthyl group.

(10) Compounds described in Japanese Laid-Open Patent Application 58-198043:

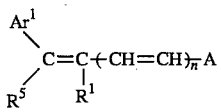

(10)

wherein n is an integer of 0 or 1; $R^1$ is hydrogen, a substituted or unsubstituted alkyl group or a substituted or unsubstituted phenyl group; $Ar^1$ is a substituted or unsubstituted aryl group; $R^5$ is a substituted or unsubstituted alkyl group or a substituted or unsubstituted aryl group; and A is

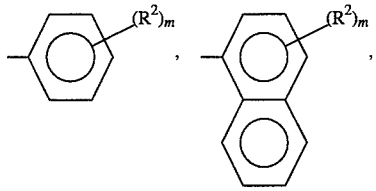

9 -anthryl group, or a substituted or unsubstituted carbazolyl group, in which $R^2$ is hydrogen, an alkyl group, an alkoxyl group, a halogen atom, or

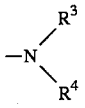

in which $R^3$ and $R^4$, which may by the same or different and may form a ring in combination, each is a substituted or unsubstituted alkyl group, a substituted or unsubstituted aralkyl group, or a substituted or unsubstituted aryl group; m is an integer of 0 to 3; and when m is 2 or more, $R^2$ may be the same or different, and when n is 0, A and $R^1$ may form a ring in combination.

(11) Compounds described in Japanese Laid-Open Patent Application 49-105537:

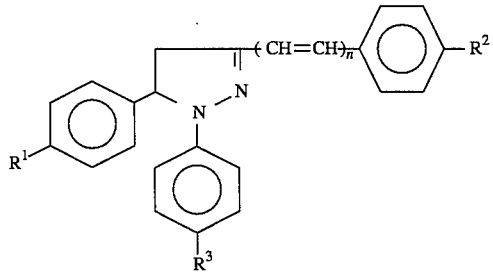

(11)

wherein $R^1$, $R^2$ and $R^3$ each is hydrogen, a lower alkyl group, a lower alkoxyl group, a dialkylamino group or a halogen atom; and n is an integer of 0 or 1.

(12) Compounds described in Japanese Laid-Open Patent Application 52-139066:

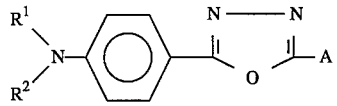

(12)

wherein $R^1$ and $R^2$ each is a substituted or unsubstituted alkyl group, or a substituted or unsubstituted aryl group; and A is a substituted amino group, or a substituted or unsubstituted aryl group, or allyl group.

(13) Compounds described in Japanese Laid-Open Patent Application 52-139065:

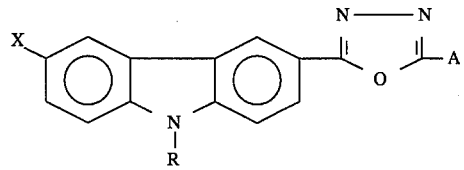

(13)

wherein X is hydrogen, a lower alkyl group or a halogen atom; R is a substituted or unsubstituted alkyl group, or a substituted or unsubstituted aryl group; and A is a substituted amino group, or a substituted or unsubstituted aryl group.

(14) Compounds described in Japanese Patent Publication 58-32372:

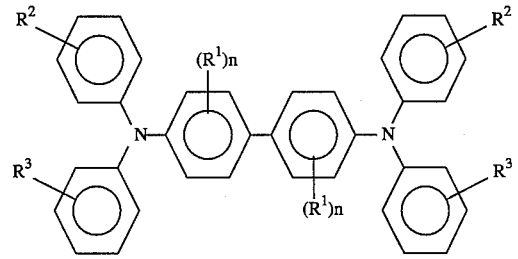

(14)

wherein $R^1$ is a lower alkyl group, a lower alkoxyl group or a halogen atom; n is an integer of 0 to 4; and $R^2$ and $R^3$, which may be the same or different, each is hydrogen, a lower alkyl group, a lower alkoxyl group or a halogen atom.

(15) Compounds described in Japanese Laid-Open Patent Application 2-178669:

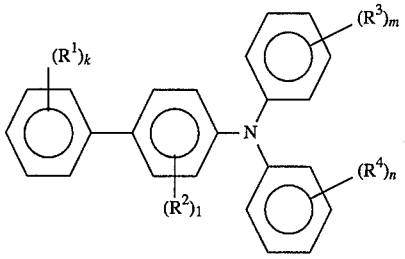

(15)

wherein $R^1$, $R^3$ and $R^4$ each is hydrogen, amino group, an alkoxyl group, a thioalkoxyl group, an aryloxy group, methylenedioxy group, a substituted or unsubstituted alkyl group, a halogen atom, or a substituted or unsubstituted aryl group; $R^2$ is hydrogen, an alkoxyl group, a substituted or unsubstituted alkyl group, or a halogen atom, except the case where $R^1$, $R^2$, $R^3$ and $R^4$ are all hydrogen at the same time; and k, l, m and n each is an integer of 1 to 4, and when each is 2, 3 or 4, $R^1$, $R^2$, $R^3$ and $R^4$ may be the same or different.

(16) Compounds described in Japanese Patent Application 1-77839:

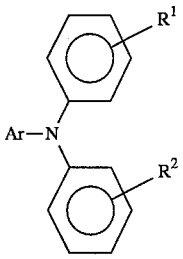

(16)

wherein Ar is a condensation polycyclic hydrocarbon group having 18 or less carbon atoms; and $R^1$ and $R^2$, which may be the same or different, each is hydrogen, a halogen atom, a substituted or unsubstituted alkyl group, an alkoxyl group, or a substituted or unsubstituted phenyl group.

(17) Compounds described in Japanese Patent Application 62-98394:

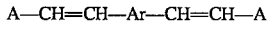

(17)

wherein Ar is a substituted or unsubstituted aromatic hydrocarbon group, and A is

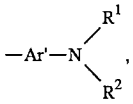

in which Ar' is a substituted or unsubstituted aromatic hydrocarbon group, and $R^1$ and $R^2$ each is a substituted or unsubstituted alkyl group or a substituted or unsubstituted aryl group.

(18) Compounds described in Japanese Patent Application 2-94812:

(18)

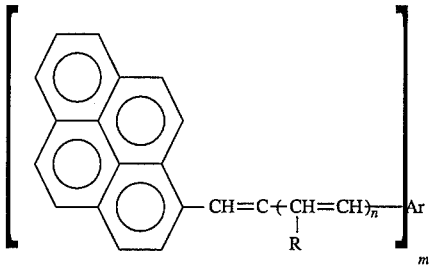

wherein Ar is an aromatic hydrocarbon group; R is hydrogen, a substituted or unsubstituted alkyl group or an aryl group; and n is an integer of 0 or 1, and m is an integer of 1 or 2, and when n=l and m=l, Ar and R may form a ring in combination.

Specific examples of the compound of formula (1) are 9-ethylcarbazole-3-aldehyde-1-methyl-1-phenylhydrazone, 9-ethylcarbazole-3-aldehyde-1-benzyl-1-phenylhydrazone, and 9-ethylcarbazole-3-aldehyde-1,1-diphenylhydrazone.

Specific examples of the compound of formula (2) are 4-diethylaminostyrene-β-aldehyde-1-methyl-1-phenylhydrazone, and 4-methoxynaphthalene-1-aldehyde-1-benzyl-1-phenylhydrazone.

Specific examples of the compound of formula (3) are 4-methoxybenzaldehyde-1-methyl-1-phenylhydrazone, 2,4-dimethoxybenzaldehyde- 1-benzyl-1-phenylhydrazone, 4-diethylaminobenzaldehyde- 1,1-diphenylhydrazone, 4-methoxybenzaldehyde- 1-benzyl-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

Specific examples of the compound of formula (4) are 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)triphenylmethane.

Specific examples of the compound of formula (5) are 9-(4-diethylaminostyryl)anthracene, and 9-bromo-10-( 4-diethylaminostyryl)anthracene.

Specific examples of the compound of formula (6) are 9-(4-dimethylaminobenzylidene)fluorene, and 3-(9-fluorenylidene)- 9-ethylcarbazole.

Specific examples of the compound of formula (7) are 1,2-bis(4-diethylaminostyryl)benzene, and 1,2-bis( 2,4-dimethoxystyryl)benzene.

Specific examples of the compound of formula (8) are 3-styryl-9-ethylcarbazole, and 3-(4-methoxystyryl)- 9-ethylcarbazole.

Specific examples of the compound of formula (9) are 4-diphenylaminostilbene, 4-dibenzylaminostilbene, 4-ditolylaminostilbene, 1-(4-diphenylaminostyryl)naphthalene, and 1-(4-diethylaminostyryl)naphthalene.

Specific examples of the compound of formula (10) are 4'-diphenylamino-α-phenylstilbene, and 4'-bis( 4-methylphenyl)amino-α-phenylstilbene.

Specific examples of the compound of formula (11) are 1-phenyl-3-(4-diethylaminostyryl)-5-( 4-diethylaminophenyl)pyrazoline, and 1-phenyl-3-(4-dimethylaminostyryl)-5-(4-dimethylaminophenyl)pyrazoline.

Specific examples of the compound of formula (12) are 2,5-bis(4-diethylaminophenyl)-1,3,4-oxadiazole, 2-N,N-diphenylamino- 5-(4-diethylaminophenul)-1,3,4oxadiazole, and 2-(4-dimethylaminophenyl)-5-( 4-diethylaminophenyl)-1,3,4-oxadiazole.

Specific examples of the compound of formula (13) are 2-N,N-diphenylamino-5-(N-ethylcarbazole- 3-yl)-1,3,4oxadiazole, and 2-(4-diethylaminophenyl)-5-(N-ethylcarbazole- 3-yl)-1,3,4-oxadiazole.

Specific examples of the compound of formula (14) are N,N'-diphenyl-N,N'-bis(3-methylphenyl)-[1,1'-biphenyl]-4,4'-diamine, and 3,3'-dimethyl-N,N,N',N'-tetrakis-( 4-methylphenyl)-[1,1'-biphenyl]-4,4'-diamine.

Specific examples of the compound of formula (15) are biphenylamine compounds such as 4'-methoxy-N,N-diphenyl-[ 1,1'-biphenyl]-4-amine, 4'-methyl-N,N-bis(4-methylphenyl)-[ 1,1'-biphenyl]-4-amine, and 4'-methoxy-N,N-bis-( 4-methylphenyl)-[1,1'-biphenyl]-4-amine.

Specific examples of the compound of formula (16) are triarylamine compounds such as 1-diphenylaminopyrene, and 1-di(p-tolylamino)pyrene.

Specific examples of the compound of formula (17) are diolefin aromatic compounds such as 1,4-bis(4-diphenylamino)styrylbenzene, and 1,4-bis[4-di(p-tolyl)aminostyryl] benzene.

Specific examples of the compound of formula (18) are styrylpyrene compounds such as 1-(4-diphenylaminostyryl)pyrene and 1-[4-di(p-tolyl)amino]styrylpyrene.

Examples of the electron-transporting material are chloroanil, bromoanil, tetracyanoethylene, tetracyanoquinone dimethane, 2,4,7-trinitro-9-fluorenone, 2,4,5,7-tetranitro-9-fluorenone, 2,4,5,7-tetranitro-xanthone, 2,4,8-trinitrothioxanthone, and 2,6,8-trinitro-4H-indeno-[ 1,2-b] thiophene-4-one, 1,3,7-trinitrodibenzothiophene- 5,5-dioxide, 3,5-dimethyl-3',5'-di-tert-butyl- 4,4'-diphenoquinone.

The above-mentioned charge transporting materials can be used alone or in combination.

In the electrophotographic photoconductor according to the present invention, a single-layered photoconductor or a function-separated laminated photoconductor can be employed.

When the single-layered photoconductor is employed, a photoconductive layer in which a charge generating material, a charge transporting material and lignin are dispersed in a binder agent is provided on an electroconductive support.

When the function-separated laminated photoconductor is employed, the photoconductive layer comprises a charge generation layer and a charge transport layer, one of which is overlaid on the other. In this case, at least one of the charge generation layer or the charge transport layer comprises lignin. In addition to the lignin, the above-mentioned antioxidant and/or alumina may be contained in at least one of the charge generation layer or the charge transport layer in the respective effective amounts thereof. For efficient improvement of the charging stability of the photoconductor, it is preferable to contain alumina in the charge generation layer.

To obtain a negatively-chargeable function-separated laminated photoconductor, a charge generation layer comprising a charge generating material and a binder agent, and a charge transport layer comprising a charge transporting material and a binder agent are successively overlaid on the electroconductive support in this order. According to the present invention, the lignin is contained in at least one of the charge generation layer or the charge transport layer. The laminating order of the charge generation layer and the charge transport layer may be reversed to prepare a positively-chargeable function-separated laminated photoconductor. To improve the photosensitivity, the charge transporting material may be contained in the charge generation layer in the function-separated laminated photoconductor, especially, in the positively-chargeable function-separated photoconductor.

Examples of the binder agent in the formation of the charge generation layer, the charge transport layer, or the single-layered photoconductive layer are polycarbonate resin (bisphenol A type and bisphenol Z type), polyester, methacrylic resin, acrylic resin, polyethylene, vinyl chloride, vinyl acetate, polystyrene, phenolic resin, epoxy resin, polyurethane, vinylidene chloride, alkyd resin, silicone resin, polyvinylcarbazole, polyvinyl butyral, polyvinyl formal, polyarylate, polyacrylamide, polyamide and phenoxy resin. These binder agents can be used alone or in combination.

When the negatively-chargeable photoconductor is prepared by providing the charge generation layer and the charge transport layer on the electroconductive support, it is preferable that the amount of the charge generating material be in a range of 10 to 500 parts by weight to 100 parts by weight of the binder agent in the charge generation layer. The proper thickness of the charge generation layer is in a range of 0.1 to 5 μm. In this case, it is preferable that the amount of the charge transporting material be in a range of 20 to 200 parts by weight to 100 parts by weight of the binder agent in the charge transport layer. The proper thickness of the charge transport layer is in a range of 5 to 50 μm.

When the positively-chargeable photoconductor is prepared by providing the charge transport layer and the charge generation layer on the electroconductive support, it is preferable that the amount of the charge transporting material be in a range of 20 to 200 parts by weight to 100 parts by weight of the binder agent in the charge transport layer. The proper thickness of the charge transport layer is in a range of 5 to 50 μm. In this case, it is preferable that the amount of the charge generating material be in a range of 10 to 500 parts by weight to 100 parts by weight of the binder agent in the charge generation layer. In addition, it is preferable that the charge generation layer further comprise the charge transporting material to prevent the increase of the residual potential and improve the photosensitivity. In such a case, it is preferable that the amount of the charge transporting material be in a range of 20 to 200 parts by weight to 100 parts by weight of the binder agent in the charge generation layer. The proper thickness of the charge generation layer is in a range of 0.1 to 10 μm.

In the case of the single-layered photoconductive layer, it is preferable that the amount of the charge transporting material and that of the charge generating material be respectively 50 to 150 parts by weight, and 0.5 to 50 parts by weight, to 100 parts by weight of the binder agent in the single-layered photoconductive layer. The proper thickness of the single-layered photoconductive layer is in a range of 5 to 50 μm.

In the electrophotographic photoconductor according to the present invention, it is preferable that the amount of lignin be in a range of 0.001 to 10.0 parts by weight to 100 parts by weight of the charge transporting material in the single-layered photoconductive layer.

When the lignin is contained in the charge generation layer of the function-separated laminated photoconductor, the amount of lignin is preferably in a range of 0.01 to 20.0 parts by weight to 100 parts by weight of the charge generating material in the charge generation layer. Further, when the charge transport layer comprises lignin, the amount of lignin is preferably in a range of 0.001 to 5.0 parts by weight to 100 parts by weight of the charge transporting material.

When the lignin is employed in combination with the antioxidant, it is preferable that the amount of the antioxidant be within the same range as that of the lignin as previously mentioned.

The durability of the photoconductor can be improved without inducing the decrease of photosensitivity when the amount of lignin, and the amount of the antioxidant are within the previously mentioned range.

To prepare the charge generation layer or the charge transport layer, the following solvents or dispersion media are employed: N,N'-dimethylformamide, acetone, methyl ethyl ketone, cyclohexanone, benzene, toluene, xylene, chloroform, 1,2-dichloroethane, dichloromethane, monochlorobenzene, tetrahydrofuran, dioxane, methanol, ethanol, isopropanol, ethyl acetate, butyl acetate, and dimethyl sulfoxide.

The coating liquid for the single-layered photoconductive layer, or the charge generation layer or the charge transport layer may be coated on the electroconductive support by dip coating or spray coating.

A metallic drum or sheet made of aluminum, brass, stainless steel or nickel can be used as the electroconductive support of the photoconductor. Alternatively, the electroconductive support can be prepared by depositing a metal such as aluminum or nickel on a film of polyethylene terephthalate, polypropylene or nylon and a sheet of paper; and by coating a plastic film and a sheet of paper, which may be in the cylindrical form, with an electroconductive material such as titanium oxide, tin oxide, or carbon black together with a proper binder agent to impart the electroconductivity.

Further, an intermediate layer may be provided between the photoconductive layer and the electroconductive support, when necessary, to increase the adhesion of the photoconductive layer to the electroconductive support, and to improve the electric-charge blocking properties.

The intermediate layer for use in the present invention comprises a resin as the main component. A resin with high resistance to generally used organic solvents is preferably employed because the photoconductive layer is provided on the intermediate layer using a solvent. Examples of such a resin for use in the intermediate layer include water-soluble resins such as polyvinyl alcohol, casein and sodium polyacrylate; alcohol-soluble resins such as copolymer nylon and methoxymethylated nylon; and cured resins with three dimensional network structure such as polyurethane, melamine resin, phenolic resin, alkyd—melamine resin and epoxy resin.

In addition, finely-divided pigment particles of metallic oxides such as titanium oxide, silica, alumina, zirconium oxide, tin oxide and indium oxide may be contained in the intermediate layer to prevent the appearance of moire and to reduce the residual potential.

The intermediate layer may further comprise lignin alone, or lignin and the antioxidant in combination.

Furthermore, a protective layer may be provided on the photoconductive layer to improve the abrasion resistance and mechanical durability of the electrophotographic photoconductor.

Other features of this invention will become apparent in the course of the following description of exemplary embodiments, which are given for illustration of the invention and are not intended to be limiting thereof.

EXAMPLE 1

[Formation of charge generation layer]

25 parts by weight of a charge generating material P-1 having the following formula and 625 parts by weight of a 1.6% cyclohexanone solution of a polyester resin (Trademark "Vylon 200" made by Toyobo Company, Ltd.) were mixed and ground together with zirconium oxide balls in a pot for 24 hours. With the further addition of 2,290 parts by weight of cyclohexanone, the mixture was dispersed in a ball mill to prepare a dispersion. The thus obtained dispersion was coated on an aluminum surface of an aluminum-deposited polyester film by a doctor blade, and dried at 120° C. for 10 minutes, so that a charge generation layer with a thickness of about 1 μm was formed on the aluminum-deposited polyester film.

(Charge generating material P-1)

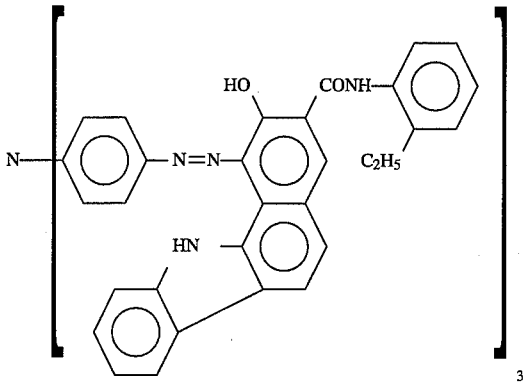

[Formation of charge transport layer]

Two parts by weight of a charge transporting material D-1 having the following formula, 2 parts by weight of a bisphenol A type polycarbonate resin (Trademark "C1400" made by Teijin Chemicals Limited.), 0.004 parts by weight of alkali lignin, and 16 parts by weight of tetrahydrofuran were mixed to prepare a solution.

(Charge transporting material D-1)

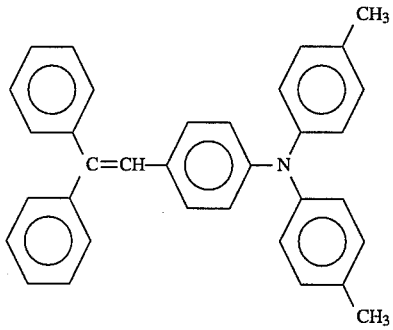

This solution was coated on the above formed charge generation layer by a doctor blade and then dried at 80° C. for 5 minutes and then at 120° C. for 15 minutes, so that a charge transport layer with a thickness of about 20 μm was formed on the charge generation layer.

Thus, an electrophotographic photoconductor No. 1 according to the present invention was obtained.

EXAMPLES 2 to 8

The procedure for preparation of the electrophotographic photoconductor No. 1 in Example 1 was repeated except that alkali lignin in an amount of 0.004 parts by weight for use in the formulation of the charge transport layer coating liquid in Example 1 was replaced by the respective lignins as shown in Table 11.

Thus, electrophotographic photoconductors No. 2 to No. 8 according to the present invention were obtained.

TABLE 11

| | Employed Lignin (parts by weight) |
|---|---|
| Ex. 2 | Propionate lignin (0.004) |
| Ex. 3 | 2-hydroxypropyl ether alkali lignin (0.004) |
| Ex. 4 | "Lignin, hydrolytic" (0.004) [*] |
| Ex. 5 | Acetic acid lignin (0.100) |
| Ex. 6 | 2-acetoxyethyl ether lignin (0.010) |
| Ex. 7 | 2-hydroxyethyl ether lignin (0.002) |
| Ex. 8 | "Lignin, organosolv" (0.002) [*] |

[*] Trademark, made by Aldrich Chemical Company, Inc.

EXAMPLE 9

The procedure for preparation of the electrophotographic photoconductor No. 1 in Example 1 was repeated except that 0.004 parts by weight of an antioxidant (Compound No. 24 in Table 2) was added to the formulation of the charge transport layer coating liquid in Example 1.

Thus, an electrophotographic photoconductor No. 9 according to the present invention was obtained.

EXAMPLES 10 to 13

The procedure for preparation of the electrophotographic photoconductor No. 9 in Example 9 was repeated except that the antioxidant (Compound No. 24 in Table 2) for use in the formulation of the charge transport layer coating liquid in Example 9 was replaced by antioxidants No. 31 (shown in Table 4), No. 44 (shown in Table 5), No. 106 (shown in Table 6), and No. 127 (shown in Table 10), respectively in Examples 10, 11, 12 and 13.

Thus, electrophotographic photoconductors No. 10 to No. 13 according to the present invention were obtained.

EXAMPLE 14

The procedure for preparation of the electrophotographic photoconductor No. 1 in Example 1 was repeated except that 0.004 parts by weight of the alkali lignin for use in the formulation of the charge transport layer coating liquid in Example 1 was replaced by a mixture of 0.002 parts by weight of propionate lignin and 0.002 parts by weight of an antioxidant (Compound No. 24 in Table 2).

Thus, an electrophotographic photoconductor No. 14 according to the present invention was obtained.

EXAMPLES 15 to 17

The procedure for preparation of the electrophotographic photoconductor No. 14 in Example 14 was repeated except that the antioxidant (Compound No. 24 in Table 2) for use in the formulation of the charge transport layer coating liquid in Example 14 was replaced by antioxidants No. 44 (shown in Table 5), No. 106 (shown in Table 6), and No. 118 (shown in Table 9), respectively in Examples 15, 16 and 17.

Thus, electrophotographic photoconductors No. 15 to No. 17 according to the present invention were obtained.

EXAMPLE 18

[Formation of charge generation layer]

25 parts by weight of the same charge generating material P-1 as employed in Example 1, 1 part by weight of dealkalized lignin, and 625 parts by weight of a 1.6% cyclohexanone solution of a polyester resin (Trademark "Vylon 200" made by Toyobo Company, Ltd.) were mixed and ground together with zirconium oxide balls in a pot for 24 hours. With the further addition of 2,290 parts by weight of cyclohexanone, the mixture was dispersed in a ball mill to prepare a dispersion. The thus obtained dispersion was coated on an aluminum surface of an aluminum-deposited polyester film by a doctor blade, and dried at 120° C. for 10 minutes, so that a charge generation layer with a thickness of about 1 μm was formed on the aluminum-deposited polyester film.

[Formation of charge transport layer]

Two parts by weight of the same charge transporting material as employed in Example 1, 2 parts by weight of a bisphenol A type polycarbonate resin (Trademark "C1400" made by Teijin Limited.), and 18 parts by weight of dichloromethane were mixed to prepare a solution.

This solution was coated on the above formed charge generation layer by a doctor blade and then dried at 80° C. for 5 minutes and then at 120° C. for 15 minutes, so that a charge transport layer with a thickness of about 20 μm was formed on the charge generation layer.

Thus, an electrophotographic photoconductor No. 18 according to the present invention was obtained.

EXAMPLES 19 to 28

The procedure for preparation of the electrophotographic photoconductor No. 18 in Example 18 was repeated except that dealkalized lignin for use in the formulation of the charge generation layer coating liquid in Example 18 was replaced by the respective lignins as shown in Table 12.

Thus, electrophotographic photoconductors No. 19 to No. 28 according to the present invention were obtained.

TABLE 12

| | Employed Lignin |
|---|---|
| Ex. 18 | Dealkalized lignin |
| Ex. 19 | Alkali lignin |
| Ex. 20 | "Lignin, hydrolytic" [*] |
| Ex. 21 | "Lignin, hydrolytic hydroxymethyl derivative" [*] |
| Ex. 22 | 2-hydroxypropyl ether alkali lignin |
| Ex. 23 | Carboxymethyl ether alkali lignin |
| Ex. 24 | "Lignin, organosolv" [*] |
| Ex. 25 | Acetic acid lignin |
| Ex. 26 | Propionate lignin |
| Ex. 27 | 2-acetoxyethyl ether lignin |
| Ex. 28 | 2-hydroxyethyl ether lignin |

[*] Trademark, made by Aldrich Chemical Company, Inc.

EXAMPLE 29

[Formation of charge generation layer]

25 parts by weight of the same charge generating material P-1 as employed in Example 1, 1 part by weight of dealkalized lignin, and 625 parts by weight of a 1.6% cyclohexanone solution of a polyester resin (Trademark "Vylon 200" made by Toyobo Company, Ltd.) were mixed and ground together with alumina balls in a pot for 24 hours. With the further addition of 2,290 parts by weight of cyclohexanone, the mixture was dispersed in a ball mill to prepare a dispersion. The thus obtained dispersion was coated on an aluminum surface of an aluminum-deposited polyester film by a doctor blade, and dried at 120° C. for 10 minutes, so that a charge generation layer with a thickness of about 1 μm was formed on the aluminum-deposited polyester film.

[Formation of charge transport layer]

Two parts by weight of the same charge transporting material as employed in Example 1, 2 parts by weight of a bisphenol A type polycarbonate resin (Trademark "C1400" made by Teijin Limited.), and 18 parts by weight of dichloromethane were mixed to prepare a solution.

This solution was coated on the above formed charge generation layer by a doctor blade and then dried at 80° C. for 5 minutes and then at 120° C. for 15 minutes, so that a charge transport layer with a thickness of about 20 μm was formed on the charge generation layer.

Thus, an electrophotographic photoconductor No. 29 according to the present invention was obtained.

EXAMPLES 30 to 39

The procedure for preparation of the electrophotographic photoconductor No. 29 in Example 29 was repeated except that dealkalized lignin for use in the formulation of the charge generation layer coating liquid in Example 29 was replaced by the respective lignins as shown in Table 13.

Thus, electrophotographic photoconductors No. 30 to No. 39 according to the present invention were obtained.

TABLE 13

| | Employed Lignin |
|---|---|
| Ex. 30 | Alkali lignin |
| Ex. 31 | "Lignin, hydrolytic" [*] |
| Ex. 32 | "Lignin, hydrolytic hydroxymethyl derivative" [*] |
| Ex. 33 | 2-hydroxypropyl ether alkali lignin |
| Ex. 34 | Carboxymethyl ether alkali lignin |
| Ex. 35 | "Lignin, organosolv" [*] |
| Ex. 36 | Acetic acid lignin |
| Ex. 37 | Propionate lignin |
| Ex. 38 | 2-acetoxyethyl ether lignin |
| Ex. 39 | 2-hydroxyethyl ether lignin |

[*] Trademark, made by Aldrich Chemical Company, Inc.

COMPARATIVE EXAMPLE 1

The procedure for preparation of the electrophotographic photoconductor No. 1 in Example 1 was repeated except that alkali lignin for use in the formulation of the charge transport layer coating liquid in Example 1 was not employed.

Thus, a comparative electrophotographic photoconductor No. 1 was obtained.

COMPARATIVE EXAMPLE 2

The procedure for preparation of the electrophotographic photoconductor No. 29 in Example 29 was repeated except that dealkalized lignin for use in the formulation of the charge generation layer coating liquid in Example 29 was not employed.

Thus, a comparative electrophotographic photoconductor No. 2 was obtained.

To evaluate the dynamic electrostatic properties of the photoconductors, each of the above prepared electrophotographic photoconductors No. 1 to No. 39 according to the present invention and comparative electrophotographic photoconductors No. 1 and No. 2 was negatively charged in the dark under application of −6 kV for 20 seconds, using a commercially available electrostatic copying sheet testing apparatus ("Paper Analyzer Model SP-428" made by Kawaguchi Electro Works Co., Ltd.). The charging potential $V_{max}$ (V) of each photoconductor was measured.

Then, each electrophotographic photoconductor was allowed to stand in the dark for 20 seconds without applying any charge thereto, and the surface potential $V_o$ (V) of the photoconductor was measured. Then, the dark decay ratio $V_o/V_{max}$ was calculated.

Each photoconductor was exposed to light for 30 seconds in such a manner that the illuminance on the exposed surface of the photoconductor was 4.5 lux, and the exposure $E_{1/2}$ (lux.sec) required to reduce the surface potential of −800 V to ½the surface potential, that is, −400 V was measured.

Thereafter, each of the photoconductors Nos. 1 to 6 according to the present invention and the comparative photoconductor No. 1 was allowed to stand for 10 hours, and each of the photoconductors Nos. 7 to 39 according to the present invention and the comparative photoconductors 1 and 2 was allowed to stand for 20 hours, in an atmosphere of ozone at a concentration of 5 ppm, using a commercially available ozone exposure system "DY-0125H" (Trademark), made by Dylec Corporation.

After the fatigue by exposure to ozone, the charging potential $V_{max}$ (V), the surface potential $V_o$ (V) after dark decay, and the exposure $E_{1/2}$ (lux.sec) of each photoconductor were measured, and the dark decay ratio $V_o/V_{max}$ was calculated in the similar manner.

The results are shown in Table 14.

TABLE 14

| | Before Fatigue | | | After Fatigue | | |
|---|---|---|---|---|---|---|
| | Vo(V) | Vo/Vm | E½ (lux · sec) | Vo(V) | Vo/Vm | E½ (lux · sec) |
| Ex. 1 | −938 | 0.72 | 0.34 | −623 | 0.51 | 0.30 |
| Ex. 2 | −1021 | 0.75 | 0.36 | −887 | 0.67 | 0.31 |
| Ex. 3 | −1057 | 0.76 | 0.38 | −596 | 0.51 | 0.25 |
| Ex. 4 | −908 | 0.68 | 0.33 | −194 | 0.21 | 0.22 |
| Ex. 5 | −1005 | 0.72 | 0.45 | −549 | 0.48 | 0.34 |
| Ex. 6 | −1037 | 0.75 | 0.37 | −314 | 0.30 | 0.24 |
| Ex. 7 | −1090 | 0.77 | 0.36 | −359 | 0.33 | 0.23 |
| Ex. 8 | −975 | 0.73 | 0.32 | −389 | 0.37 | 0.23 |
| Ex. 9 | −1001 | 0.70 | 0.33 | −790 | 0.60 | 0.32 |
| Ex. 10 | −952 | 0.72 | 0.34 | −752 | 0.61 | 0.32 |
| Ex. 11 | −1050 | 0.74 | 0.34 | −860 | 0.66 | 0.32 |
| Ex. 12 | −1063 | 0.70 | 0.36 | −681 | 0.50 | 0.30 |
| Ex. 13 | −921 | 0.71 | 0.37 | −622 | 0.53 | 0.32 |
| Ex. 14 | −1092 | 0.76 | 0.36 | −996 | 0.71 | 0.32 |
| Ex. 15 | −1033 | 0.75 | 0.34 | −911 | 0.68 | 0.30 |
| Ex. 16 | −1027 | 0.76 | 0.35 | −850 | 0.65 | 0.29 |
| Ex. 17 | −1017 | 0.76 | 0.35 | −822 | 0.65 | 0.29 |
| Ex. 18 | −1332 | 0.86 | 0.32 | −978 | 0.69 | 0.24 |
| Ex. 19 | −1306 | 0.88 | 0.36 | −1166 | 0.81 | 0.31 |
| Ex. 20 | −1235 | 0.84 | 0.30 | −679 | 0.56 | 0.21 |
| Ex. 21 | −1168 | 0.85 | 0.33 | −982 | 0.75 | 0.27 |
| Ex. 22 | −1310 | 0.84 | 0.32 | −880 | 0.64 | 0.22 |
| Ex. 23 | −1234 | 0.84 | 0.31 | −632 | 0.53 | 0.21 |
| Ex. 24 | −1418 | 0.86 | 0.31 | −956 | 0.66 | 0.22 |
| Ex. 25 | −1233 | 0.81 | 0.32 | −565 | 0.47 | 0.21 |

TABLE 14-continued

| | Before Fatigue | | | After Fatigue | | |
|---|---|---|---|---|---|---|
| | Vo(V) | Vo/Vm | E½ (lux · sec) | Vo(V) | Vo/Vm | E½ (lux · sec) |
| Ex. 26 | −1469 | 0.88 | 0.34 | −1371 | 0.83 | 0.31 |
| Ex. 27 | −1303 | 0.82 | 0.32 | −795 | 0.59 | 0.22 |
| Ex. 28 | −1370 | 0.83 | 0.32 | −936 | 0.64 | 0.22 |
| Ex. 29 | −1346 | 0.88 | 0.40 | −1211 | 0.81 | 0.36 |
| Ex. 30 | −1363 | 0.84 | 0.42 | −1215 | 0.78 | 0.38 |
| Ex. 31 | −1411 | 0.88 | 0.37 | −1269 | 0.81 | 0.34 |
| Ex. 32 | −1408 | 0.85 | 0.40 | −1258 | 0.79 | 0.36 |
| Ex. 33 | −1441 | 0.85 | 0.40 | −1239 | 0.77 | 0.36 |
| Ex. 34 | −1476 | 0.86 | 0.37 | −1337 | 0.81 | 0.34 |
| Ex. 35 | −1571 | 0.90 | 0.41 | −1433 | 0.85 | 0.38 |
| Ex. 36 | −1386 | 0.83 | 0.37 | −1175 | 0.74 | 0.33 |
| Ex. 37 | −1478 | 0.86 | 0.40 | −1310 | 0.80 | 0.37 |
| Ex. 38 | −1430 | 0.85 | 0.44 | −1274 | 0.79 | 0.38 |
| Ex. 39 | −1536 | 0.88 | 0.40 | −1359 | 0.81 | 0.36 |
| Comp. Ex. 1(*) | −1010 | 0.73 | 0.32 | −178 | 0.19 | 0.22 |
| Comp. Ex. 1(*) | −1025 | 0.75 | 0.33 | −86 | 0.11 | Unmeasurable |
| Comp. Ex. 3 | −1249 | 0.81 | 0.39 | −1062 | 0.72 | 0.35 |

(*)The comparative electrophotographic photoconductors No. 1 and No. 1' were respectively exposed to ozone for 10 hours, and 20 hours.

In the electrophotographic photoconductors according to the present invention, a photoconductive layer comprises lignin alone, or lignin and an antioxidant or alumina in combination, so that the increase of the residual potential of the photoconductor can be prevented, and the photoconductive properties such as the charging characteristics do not deteriorate during the repeated operations for an extended period of time. Therefore, the electrophotographic photoconductors of the present invention are considered to be remarkably useful in practical use.

Japanese Patent Application No. 5-346508 filed on Dec. 22, 1993 and Japanese Patent Application No. 6-046442 filed on Feb. 21, 1994 are hereby incorporated by reference.

What is claimed is:

1. An electrophotographic photoconductor comprising an electroconductive support and a photoconductive layer formed thereon, said photoconductive layer comprising a charge generating material, a charge transporting material and lignin.

2. The electrophotographic photoconductor as claimed in claim 1, wherein said photoconductive layer further comprises an antioxidant in an effective amount.

3. The electrophotographic photoconductor as claimed in claim 1, wherein said photoconductive layer further comprises alumina in an effective amount.

4. The electrophotographic photoconductor as claimed in claim 1, wherein said photoconductive layer further comprises an antioxidant and alumina in the respective effective amounts thereof.

5. The electrophotographic photoconductor as claimed in claim 1, wherein said photoconductive layer comprises a charge generation layer comprising said charge generating material, and a charge transport layer comprising said charge transporting material, at least one of said charge generation layer or said charge transport layer comprising said lignin.

6. The electrophotographic photoconductor as claimed in claim 5, wherein said charge generation layer comprises said lignin.

7. The electrophotographic photoconductor as claimed in claim 5, wherein said charge transport layer comprises said lignin.

8. The electrophotographic photoconductor as claimed in claim 5, wherein at least one of said charge generation layer or said charge transport layer further comprises an antioxidant in an effective amount.

9. The electrophotographic photoconductor as claimed in claim 5, wherein at least one of said charge generation layer or said charge transport layer further comprises alumina in an effective amount.

10. The electrophotographic photoconductor as claimed in claim 5, wherein at least one of said charge generation layer or said charge transport layer further comprises an antioxidant and alumina in the respective effective amounts thereof.

11. The electrophotographic photoconductor as claimed in claim 6, wherein said charge generation layer further comprises alumina in an effective amount.

12. The electrophotographic photoconductor as claimed in claim 1, wherein the amount of said lignin is in a range of 0.001 to 10.0 parts by weight to 100 parts by weight of said charge transporting material in said photoconductive layer.

13. The electrophotographic photoconductor as claimed in claim 6, wherein the amount of said lignin is in a range of 0.01 to 20.0 parts by weight to 100 parts by weight of said charge generating material in said charge generation layer.

14. The electrophotographic photoconductor as claimed in claim 7, wherein the amount of said lignin is in a range of 0.001 to 5.0 parts by weight to 100 parts by weight of said charge transporting material in said charge transport layer.

15. The electrophotographic photoconductor as claimed in claim 2, wherein the amount of said antioxidant is in a range of 0.001 to 10.0 parts by weight to 100 parts by weight of said charge transporting material in said photoconductive layer.

16. The electrophotographic photoconductor as claimed in claim 8, wherein said antioxidant is contained in said charge generation layer in an amount in a range of 0.01 to 20.0 parts by weight to 100 parts by weight of said charge generating material contained in said charge generation layer.

17. The electrophotographic photoconductor as claimed in claim 8, wherein said antioxidant is contained in said charge transport layer in an amount in a range of 0.001 to 5.0 parts by weight to 100 parts by weight of said charge transporting material contained in said charge transport layer.

18. The electrophotographic photoconductor as claimed in claim 1, further comprising an intermediate layer comprising a resin, which is provided between said electroconductive support and said photoconductive layer.

19. The electrophotographic photoconductor as claimed in claim 18, wherein said intermediate layer further comprises said lignin.

20. The electrophotographic photoconductor as claimed in claim 19, wherein said intermediate layer further comprises an antioxidant.

21. The electrophotographic photoconductor as claimed in claim 1, further comprising a protective layer which is provided on said photoconductive layer.

* * * * *